US006467848B1

(12) United States Patent
Gien et al.

(10) Patent No.: US 6,467,848 B1
(45) Date of Patent: Oct. 22, 2002

(54) CHAIR HAVING A REINFORCED ATTACHING MECHANISM

(75) Inventors: Gin Chong Gien, 7F, No. 46, Pin Ho 10 street, Chang Hua (TW), 500; Wen Huang Tseng, Chang Hua (TW)

(73) Assignee: Gin Chong Gien, Chang Hua (TW)

( * ) Notice: Subject to any disclaimer, the term of this patent is extended or adjusted under 35 U.S.C. 154(b) by 0 days.

(21) Appl. No.: 09/819,564

(22) Filed: Mar. 27, 2001

(51) Int. Cl.[7] ..... A47C 1/12
(52) U.S. Cl. ..... 297/445.1; 297/383
(58) Field of Search ..... 297/445.1, 411.27, 297/411.37, 411.2, 452.1, 452.14, 337, 383, 451.1

(56) References Cited

U.S. PATENT DOCUMENTS 2,662,586 A * 12/1953 Cramer ..... 297/383
2,729,273 A * 1/1956 Hamilton et al. ..... 297/353
2,973,031 A * 2/1961 Cramer, Jr. ..... 297/383
4,054,317 A * 10/1977 Stumpf ..... 297/451.1 X
4,102,549 A * 7/1978 Morrison et al. ..... 297/353 X
5,035,466 A * 7/1991 Mathews et al. ..... 297/337
5,711,576 A * 1/1998 Olson et al. ..... 297/353

* cited by examiner

*Primary Examiner*—Peter M. Cuomo
*Assistant Examiner*—Stephen Vu

(57) ABSTRACT

A chair includes a bottom board having a channel for receiving an extension of an arm of a seat back, a mounting plate secured to the bottom board and engaged on the extension of the arm, and a supporting base device secured to the mounting plate and the bottom board. The mounting plate includes one or more cusps engaged with the bottom board for forming a gap between the mounting plate and the bottom board and for allowing the base device to be solidly secured to the mounting plate. The bottom board includes a reinforcing bulge for reinforcing the bottom board of the chair.

1 Claim, 4 Drawing Sheets

CHAIR HAVING A REINFORCED ATTACHING MECHANISM

BACKGROUND OF THE INVENTION

1. Field of the Invention

The present invention relates to a chair, and more particularly to a chair having a reinforced attaching or mounting mechanism.

2. Description of the Prior Art

As shown in FIG. 4, a typical chair comprises a seat cushion 11 disposed on a bottom board 10, a mounting plate 20 secured on the bottom board 10 with fasteners 21. A bracket 22 is required to be fixed onto the mounting plate 20 with one or more welding lines 24 and includes an orifice 221 formed therein. A supporting base device 30 includes an actuator 31, such as a pneumatic cylinder or a hydraulic cylinder disposed thereon and having a rod 33 extended therefrom for engaging and securing into the orifice 221 of the bracket 22. A seat back 26 includes an arm 27 having an extension 28 extended therefrom and secured to the mounting plate 20 with a lock pin 23 and a fastener 29 or the like. The bracket 22 is welded to the mounting plate 20 and is the weakest portion of the chair and is normally the first element disengaged from the chair after use. In addition, the arm 27 of the seat back 26 may not be solidly secured to the mounting plate 20.

The present invention has arisen to mitigate and/or obviate the afore-described disadvantages of the conventional chairs.

SUMMARY OF THE INVENTION

The primary objective of the present invention is to provide a chair having a reinforced attaching or mounting mechanism for easily and solidly mounting the seat cushion on the supporting base device.

In accordance with one aspect of the invention, there is provided a chair comprising a bottom board including a channel formed therein, a seat back including an arm having an extension engaged in the channel of the bottom board, a mounting plate secured to the bottom board and engaged on the extension of the arm, and a supporting base device secured to the mounting plate and the bottom board. The mounting plate includes at least one cusp extended therefrom and engaged with the bottom board for forming a gap between the mounting plate and the bottom board.

The bottom board includes a hub secured therein, the mounting plate includes an orifice formed therein and aligned with the hub and communicating with the gap formed between the mounting plate and the bottom board.

The supporting base device includes a rod engaged through the orifice of the mounting plate and secured into the hub.

The bottom board includes a reinforcing bulge extended therefrom and having the channel formed therein for reinforcing the bottom board of the chair.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
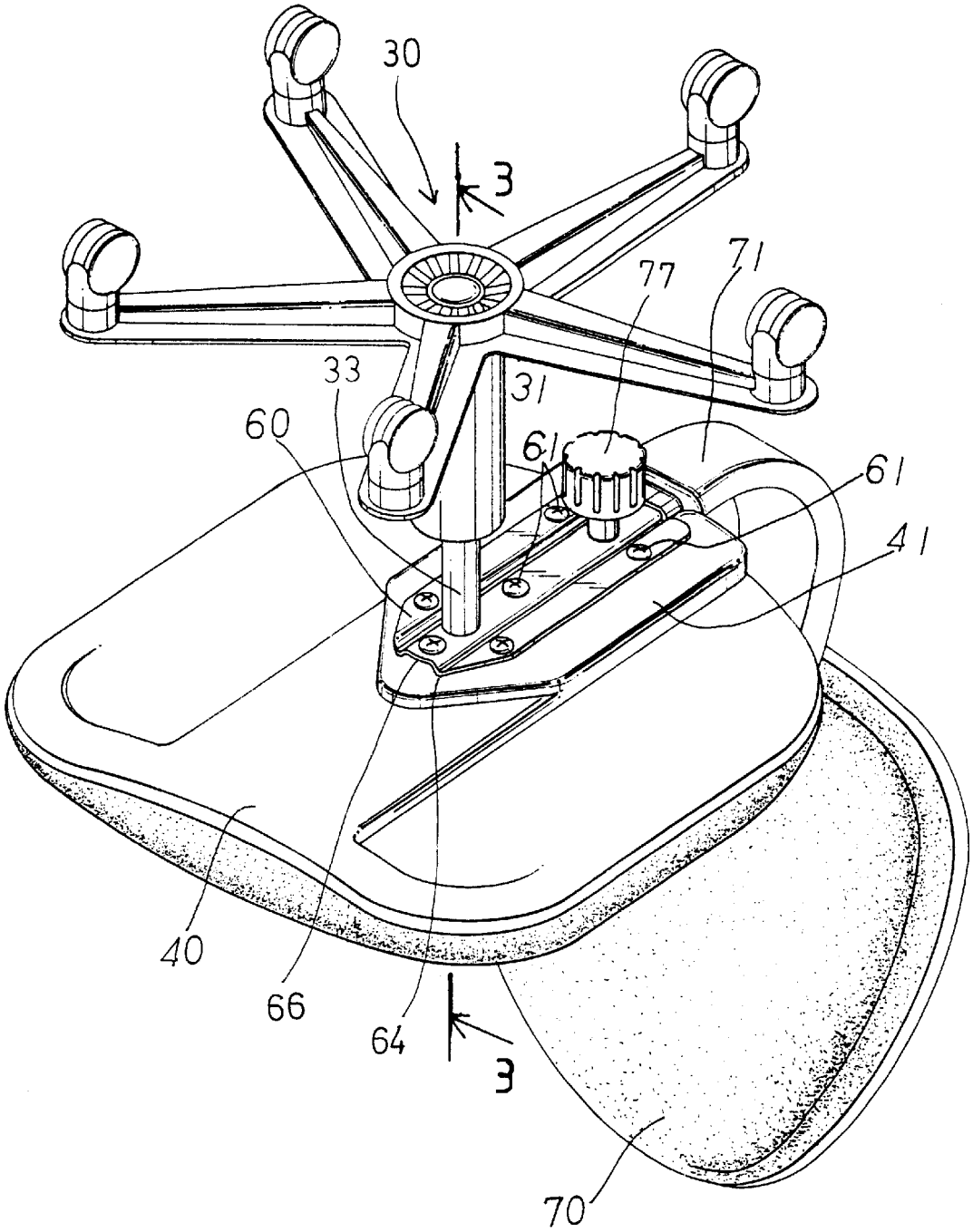
FIG. 1 is a perspective view of a chair in accordance with the present invention, in which the chair is disposed upside down.
Figure 2:
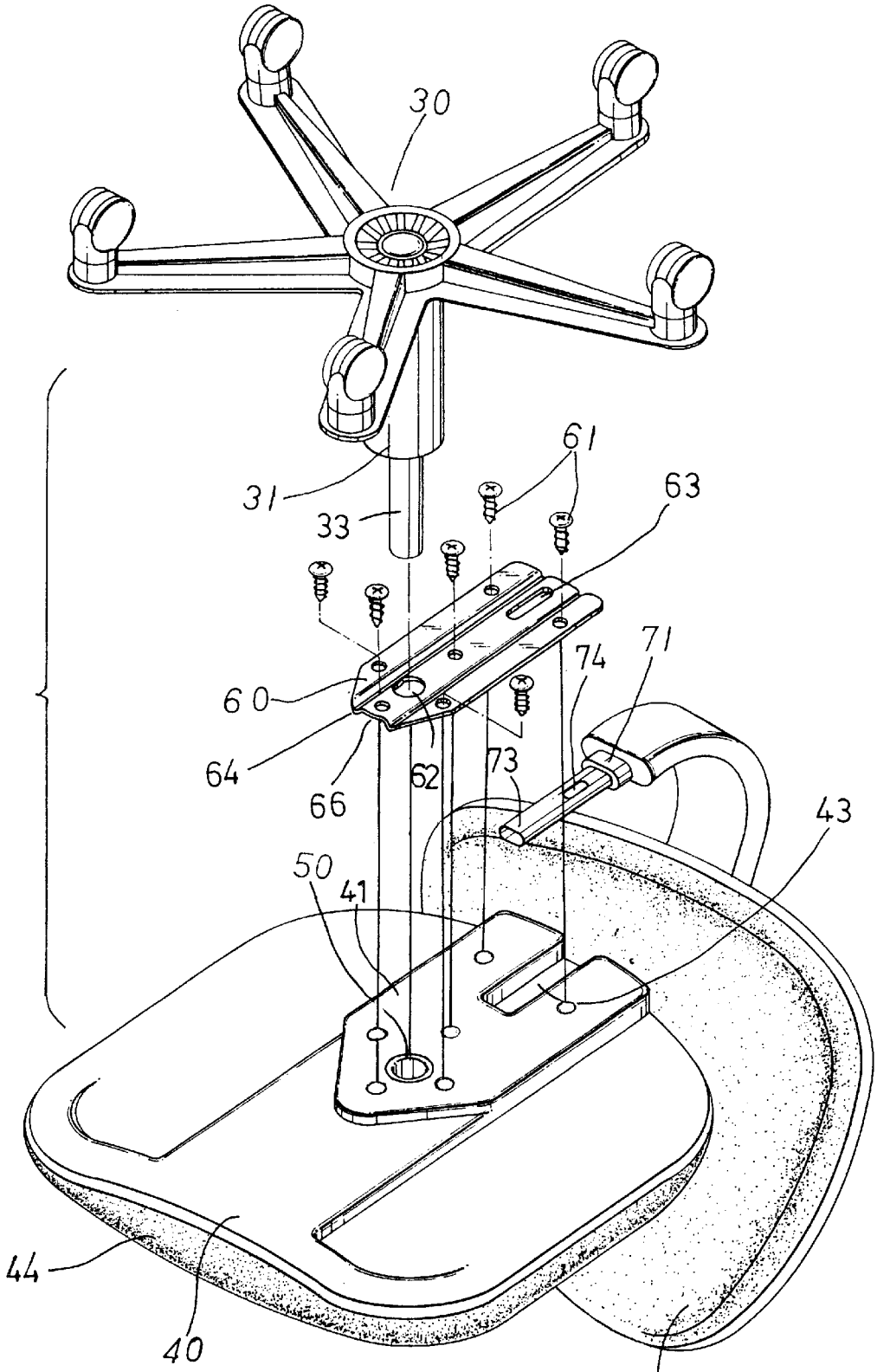
FIG. 2 is a partial exploded view of the chair, in which the chair is also disposed upside down.

Referring to the drawings, and initially to FIGS. 1 and 2, a chair in accordance with the present invention comprises a seat cushion 44 disposed on a bottom board 40. The bottom board 40 includes a reinforcing bulge 41 extended therefrom, particularly extended downward therefrom and having a channel 43 formed therein, particularly formed in the rear portion thereof. A hub 50 is secured in the bottom board 40, particularly secured in the reinforcing bulge 41 of the bottom board 40, by such as the welding processes or by adhesive materials or the like.

A mounting plate 60 is secured on the bottom board 40 with fasteners 61, and includes an oblong hole 63 formed therein, and includes an orifice 62 formed therein and aligned with the hub 50 for receiving the rod 33 of the typical actuator 31 of the supporting base device 30. The actuator 31 may be the typical pneumatic cylinder or hydraulic cylinder. A seat back 70 includes an arm 71 having an extension 73 extended therefrom and engaged into the channel 43 of the bottom board 40 and having an oblong hole 74 formed therein. A fastener 77 is engaged through the oblong holes 63 and 74 of the mounting plate 60 and of the extension 73 of the arm 71 for adjustably securing the extension 73 of the arm 71 to the bottom board 40 and the mounting plate 60.

Figure 3:
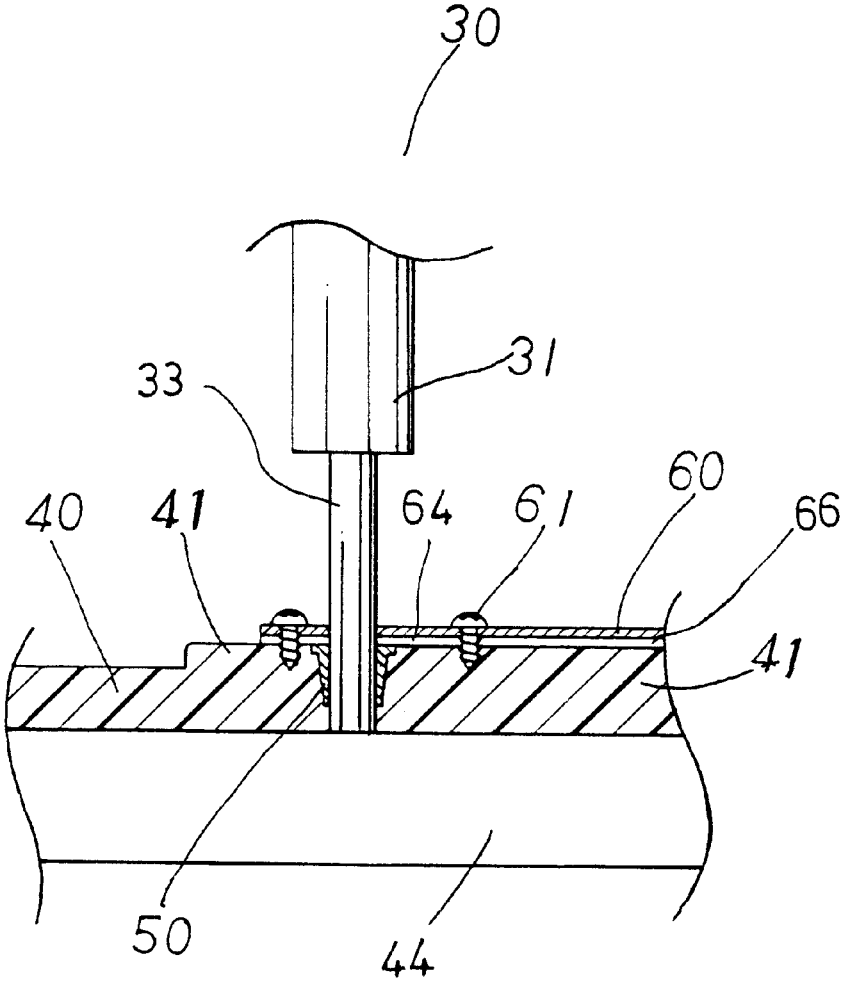
FIG. 3 is a partial cross sectional view taken along lines 3–3 of FIG. 1.
Figure 4:
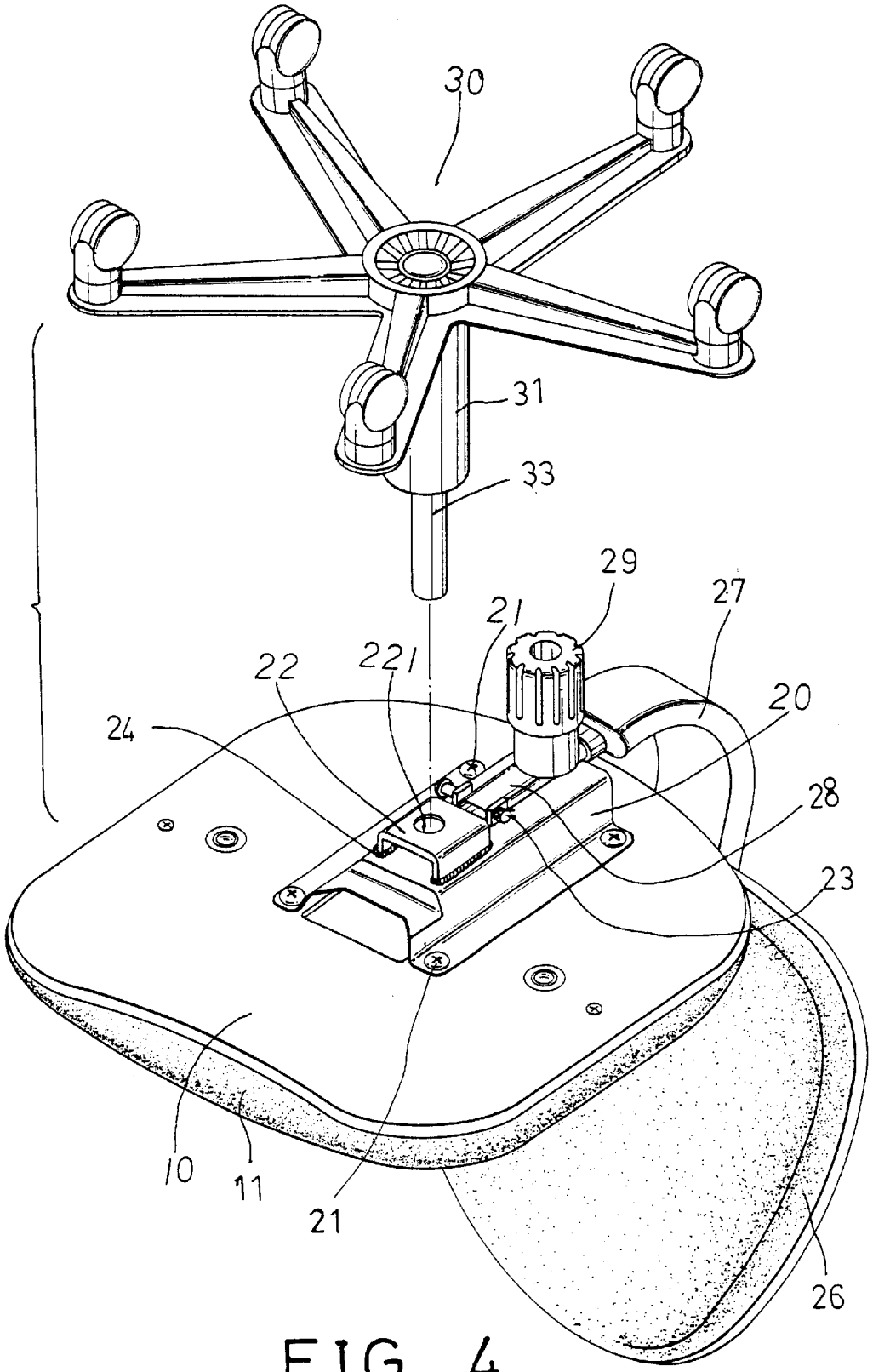
FIG. 4 PRIOR ART
FIG. 4 is a partial exploded view illustrating the attaching or mounting mechanism of the typical chair, in which the typical chair is also disposed upside down.

The mounting plate 60 includes one or more ridges or cusps 64 extended therefrom and preferably parallel to each other, and engaged with the bottom board 40, particularly engaged with the reinforcing bulge 41 of the bottom board 40, for forming or defining a gap 66 (best shown in FIG. 3) between the bottom board 40 and the mounting plate 60, particularly between the reinforcing bulge 41 of the bottom board 40 and the middle portion of the mounting plate 60. The cusps 64 of the mounting plate 60 may be formed on the mounting plate 60 by a simple hammering or forging process. The orifice 62 and the oblong hole 63 of the mounting plate 60 may also be formed in the hammering or forging process simultaneously and communicating with the gap 66 formed between the cusps 64 of the mounting plate 60.

It is to be noted that typical mounting bracket is no longer required to be provided and welded onto the mounting plate. The chair in accordance with the present invention includes a mounting plate 60 having one or more cusps 64 extended therefrom for forming the gap 66 between the mounting plate 60 and the bottom board 40, and for allowing the rod 33 to be solidly secured to the mounting plate 60 and the bottom board 40, without additional mounting brackets. In addition, the extension 73 of the arm 71 of the seat back 70 may be solidly engaged into the channel 43 of the bottom board 40, and may be partially received in the gap 66 that is formed between the cusps 64 of the mounting plate 60, and may thus be solidly secured to the mounting plate 60. The extension 73 of the arm 71 of the seat back 70 may thus be solidly and adjustably secured into the channel 43 of the bottom board 40 by the adjusting engagement of the fastener 77 in the oblong hole 63 of the mounting plate 60.

Accordingly, the chair in accordance with the present invention includes a reinforced attaching or mounting mechanism for easily and solidly mounting the seat cushion on the supporting base device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A chair comprising:

a bottom board including a channel formed therein, a hub engaged in said bottom board, a seat back including an arm having an extension engaged in said channel of said bottom board, a mounting plate secured to said bottom board and engaged on said extension of said arm, said mounting plate including at least one cusp extended therefrom and engaged with said bottom board for forming a gap between said mounting plate and said bottom board, said mounting plate including an orifice formed therein and aligned with said hub and communicating with said gap formed between said mounting plate and said bottom board, and a supporting base device secured to said mounting plate and said bottom board, said supporting base device including a rod engaged through said orifice of said mounting plate and secured into said hub.

* * * * *